US009616695B2

(12) United States Patent
Nagoshi et al.

(10) Patent No.: US 9,616,695 B2
(45) Date of Patent: Apr. 11, 2017

(54) COATED PRINTING PAPER FOR INDUSTRIAL INKJET PRINTING PRESS

(71) Applicant: MITSUBISHI PAPER MILLS LIMITED, Tokyo (JP)

(72) Inventors: Masanori Nagoshi, Tokyo (JP); Toru Kaneko, Tokyo (JP); Atsushi Nakamura, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 15/026,416

(22) PCT Filed: Aug. 7, 2014

(86) PCT No.: PCT/JP2014/070808
§ 371 (c)(1),
(2) Date: Mar. 31, 2016

(87) PCT Pub. No.: WO2015/049922
PCT Pub. Date: Apr. 9, 2015

(65) Prior Publication Data

US 2016/0243869 A1 Aug. 25, 2016

(30) Foreign Application Priority Data

Oct. 2, 2013 (JP) ..... 2013-207213

(51) Int. Cl.

| | |
|---|---|
| ***B41M 5/00*** | (2006.01) |
| ***B41M 5/50*** | (2006.01) |
| ***B41M 5/52*** | (2006.01) |
| ***D21H 17/67*** | (2006.01) |
| ***D21H 19/38*** | (2006.01) |
| ***D21H 21/52*** | (2006.01) |
| ***D21H 19/64*** | (2006.01) |

(52) U.S. Cl.
CPC ..... *B41M 5/50* (2013.01); *B41M 5/508* (2013.01); *B41M 5/52* (2013.01); *B41M 5/5218* (2013.01); *B41M 5/5254* (2013.01); *D21H 17/675* (2013.01); *D21H 19/385* (2013.01); *D21H 19/64* (2013.01); *D21H 21/52* (2013.01)

(58) Field of Classification Search
CPC ..... B41M 5/52; B41M 5/5254; B41M 5/508; B41M 5/5218
See application file for complete search history.

(56) References Cited

U.S. PATENT DOCUMENTS

| | | | | |
|---|---|---|---|---|
| 2010/0310796 | A1 | 12/2010 | Nishiiri et al. | |
| 2012/0107531 | A1* | 5/2012 | Idei | D21H 19/385 428/32.31 |
| 2013/0176371 | A1* | 7/2013 | Nagoshi | D21H 19/44 347/106 |
| 2013/0187977 | A1* | 7/2013 | Idei | D21H 19/44 347/20 |
| 2016/0243869 | A1* | 8/2016 | Nagoshi | D21H 17/675 |

FOREIGN PATENT DOCUMENTS

| | | | |
|---|---|---|---|
| JP | 2005-88525 | A | 4/2005 |
| JP | 2006-89852 | A | 4/2006 |
| JP | 2006-256001 | A | 9/2006 |
| JP | 2010-236153 | A | 10/2010 |
| JP | 2011-148194 | A | 8/2011 |
| JP | 2011-251231 | A | 12/2011 |
| JP | 2012-214012 | A | 11/2012 |
| WO | WO 2009/066662 | A1 | 5/2009 |

OTHER PUBLICATIONS

Miyagi, "Offset Quality Inkjet Printing Press", Japan Printer, Insatsu Gakkai Shuppanbu Ltd., vol. 93, Aug. 2010, pp. 25-29.
Tokumasu, "Inkjet Printing Press Compatible with B2 WideFormat Printing Paper", Japan Printer, Insatsu Gakkai Shuppanbu Ltd., vol. 93, Aug. 2010, pp. 21-24.

* cited by examiner

*Primary Examiner* — Betelhem Shewareged
(74) *Attorney, Agent, or Firm* — Birch, Stewart, Kolasch & Birch, LLP

(57) ABSTRACT

The present invention provides coated printing paper for industrial inkjet printing presses comprising base paper and, formed on at least one surface of the base paper, a coating layer containing a pigment and a binder as major components, wherein the base paper contains precipitated calcium carbonate which is aggregates of spindle-like precipitated calcium carbonate having an average minor-axis length of 0.3 μm to 0.4 μm and a ratio of average major-axis length/average minor-axis length of 2.0 to 7.0 and which has an average secondary particle diameter of 3.0 μm to 5.5 μm, and further contains at least one material selected from the group consisting of a cationic resin and a water-soluble salt of a polyvalent cation, and the coating layer contains ground calcium carbonate having an average particle diameter of 0.1 μm to 0.28 μm in an amount of 60 parts by mass or greater based on 100 parts by mass of the total pigment contained in the coating layer.

16 Claims, No Drawings

COATED PRINTING PAPER FOR INDUSTRIAL INKJET PRINTING PRESS

TECHNICAL FIELD

The present invention relates to coated printing paper for industrial inkjet printing presses that is used for industrial inkjet printing presses employed in the field of commercial printing.

BACKGROUND ART

Technologies for inkjet recording method have rapidly progressed, and industrial inkjet printing presses in which an inkjet recording method is employed for an industrial or commercial printing press to produce a multiple sheets of commercial printed materials have been publicly known (e.g., see Japanese Patent Application Kokai Publication No. 2011-251231 (unexamined, published Japanese patent application), Japanese Patent Application Kokai Publication No. 2005-088525 (unexamined, published Japanese patent application), "Inkjet Printing press Compatible with B2 Wide Format Printing Paper" by Michiko Tokumasu (Japan Printer, published by Insatsu Gakkai Shuppanbu Ltd., August 2010 (Vol. 93), pp. 21-24), and "Offset Quality Inkjet Printing press" by Yasutoshi Miyagi (Japan Printer, Insatsu Gakkai Shuppanbu Ltd., August 2010 (Vol. 93), pp. 25-29)). Industrial inkjet printing presses are marketed under trade names such as Truepress Jet manufactured by Dainippon Screen Mfg. Co., Ltd., the MJP Series manufactured by Miyakoshi Printing Machinery Co., Ltd., Prosper and Versamark manufactured by Eastman Kodak Co., and JetPress manufactured by Fujifilm Corp.

These industrial inkjet printing presses feature color printing speeds that are ten to several tens of times faster than inkjet printers for home and small office/home office (SOHO) use as well as wide format inkjet printers (hereinafter, both of these are collectively and simply referred to as "inkjet printers"), demonstrating printing speeds of 15 m/min or higher and exceeding 60 m/min in the case of high-speed printing, depending on various printing conditions. Because of this, industrial inkjet printing presses are distinguished from inkjet printers for home and SOHO use and wide format inkjet printers.

Inks used for industrial inkjet printing presses include water-based dye inks and water-based pigment inks in the same manner as in those of inkjet printers.

Since industrial inkjet printing presses are capable of handling variable information, they can be adapted to on-demand printing. There are many cases where printing firms employ a system by which fixed information is printed with conventional printing presses such as gravure printing presses, offset printing presses, letterpress printing presses, flexographic printing presses, thermal transfer printing presses, or toner printing presses, and variable information is printed with industrial inkjet printing presses. As conventionally used printing presses, in particular, offset printing presses are often used from the perspectives of quality of printed images and production cost.

Therefore, coated printing paper for industrial inkjet printing presses is required to have printability for both printing by conventional printing presses such as offset printing presses and printing by industrial inkjet printing presses. If such printability is not exhibited, quality of image that is sufficient as a commercial product cannot be achieved by printing using these printing presses.

Furthermore, to satisfy the demands for enhancing definition and image quality of commercial printing, coated printing paper that can be used for industrial inkjet printing presses and that has similar texture as the texture of coated printing paper, such as general purpose CWF matte coated paper and CWF gloss coated paper, has been desired.

Inkjet recording paper which exhibits high printing density and high ink absorbency and does not cause strike-through, even when printing is performed by an inkjet printer using either water-based dye ink or water-based pigment ink, has been publicly known (e.g., see Japanese Patent Application Kokai Publication No. 2006-256001 (unexamined, published Japanese patent application)). In this recording paper, at least one surface of base paper containing, as major components, pulp and a filler mainly containing rosette-type precipitated calcium carbonate having an average particle diameter of 1.6 μm or greater and an oil absorption of 90 mL/100 g to 200 mL/100 g is provided with at least one layer of ink receiving layer containing a pigment and a binder. Furthermore, the ash content stipulated in JIS-P8251 of the base paper is 15 to 40%.

BACKGROUND ART DOCUMENTS

Patent Documents

Patent Document 1: Japanese Patent Application Kokai Publication No. 2011-251231 (unexamined, published Japanese patent application)

Patent Document 2: Japanese Patent Application Kokai Publication No. 2005-088525 (unexamined, published Japanese patent application)

Patent Document 3: Japanese Patent Application Kokai Publication No. 2006-256001 (unexamined, published Japanese patent application)

Non-Patent Documents

Non-Patent Document 1: Michiko Tokumasu, "Inkjet Printing press Compatible with B2 Wide Format Printing Paper" (Japan Printer, Insatsu Gakkai Shuppanbu Ltd., August 2010 (Vol. 93), pp. 21-24)

Non-Patent Document 2: Yasutoshi Miyagi, "Offset Quality Inkjet Printing press" (Japan Printer, Insatsu Gakkai Shuppanbu Ltd., August 2010 (Vol. 93), pp. 25-29)

SUMMARY OF THE INVENTION

Problem to be Solved by the Invention

Water-based dye inks and water-based pigment inks have different disadvantages. Water-based dye inks easily allow coloring material to permeate together with ink solvents. As a result, the printing density may be lowered. Because of this, coated printing paper that enhances printing density has been desired. Water-based pigment inks easily cause unevenness in ink absorbency of the coated printing paper as the printing speed is increased. As a result, color densities of the printed part may be uneven. Because of this, coated printing paper that can suppress the unevenness of color densities has been desired. Due to restrictions on the principle, that is an ink droplet is jetted from a fine nozzle, inks for industrial inkjet printing presses have lower coloring material concentrations of the inks compared to those of inks for conventional printing presses, such as offset printing presses. Because of this, a phenomenon in which printing density is lowered and/or a phenomenon in which color densities become uneven easily occur.

Furthermore, a phenomenon of strike-through of ink easily occurs since ink solvent is contained at a large amount due to the low coloring material concentration of the ink. "Strike-through of ink" is a phenomenon in which the ink does not stop on the surface of the printed side but reaches the deep portion of the base paper, and thus the printed image can be visually recognized from the surface on the other side. In commercial printing, printing is often performed on the both surfaces, and the strike-through of ink impairs sufficient image quality as a commercial product.

Inkjet recording paper, such as the paper described in Japanese Patent Application Kokai Publication No. 2006-256001 (unexamined, published Japanese patent application), is only evaluated for inkjet printers for A4 size, and has not been sufficiently investigated for industrial inkjet printing presses. Furthermore, although this inkjet recording paper can suppress strike-through of the ink when an inkjet printer is used, suppression capability of a phenomenon in which color densities of the printed part become uneven when an industrial inkjet printing press using water-based pigment ink is used, and printability when an offset printing press is used are not necessarily sufficient. Note that "printability when an offset printing press is used" refers to suppression of printing failure such as blanket piling.

An object of the present invention is to provide coated printing paper for industrial inkjet printing presses achieving at least one of the functions described below.

1. Achieve printability when an offset printing press is used (offset printability)

2. Achieve suitable printing density without causing lowering of printing density when an industrial inkjet printing press using a water-based dye ink is used (color developing properties)

3. Suppress strike-through of ink sufficiently when an industrial inkjet printing press using a water-based dye ink is used (suppression capability of strike-through of ink)

4. Suppress a phenomenon, in which color densities in the printed part become uneven when an industrial inkjet printing press using a water-based pigment ink is used (unevenness resistance)

5. Suppress strike-through of ink sufficiently when an industrial inkjet printing press using a water-based pigment ink is used (suppression capability of strike-through of ink)

Means for Solving the Problems

As a result of diligent research conducted by the inventors of the present invention in light of the circumstances described above, an object of the present invention can be achieved by coated printing paper for industrial inkjet printing presses, the coated printing paper comprising: base paper, and a coating layer formed on at least one surface of the base paper, the coating layer containing a pigment and a binder as major components; wherein the base paper contains precipitated calcium carbonate which is an aggregate of spindle-like precipitated calcium carbonate having an average minor-axis length of 0.3 μm to 0.4 μm and a ratio of average major-axis length/average minor-axis length of 2.0 to 7.0 and which has an average secondary particle diameter of 3.0 μm to 5.5 μm; and at least one material selected from the group consisting of a cationic resin and a water-soluble salt of a polyvalent cation; and the coating layer contains ground calcium carbonate having an average particle diameter of 0.1 μm to 0.28 μm in an amount of 60 parts by mass or greater based on 100 parts by mass of the total pigment contained in the coating layer.

According to the present invention, coated printing paper for industrial inkjet printing presses which has good printability using an offset printing press and which achieves color developing properties and suppression capability of strike-through of ink when an industrial inkjet printing press using a water-based dye ink is used, and unevenness resistance and suppression capability of strike-through of ink when an industrial inkjet printing press using a water-based pigment ink is used can be provided.

As another embodiment of the present invention, method of producing a printed material, the method comprising a step of preparing the coated printing paper for industrial inkjet printing presses described above, and a step of forming printed image on the coated printing paper for industrial inkjet printing presses by an industrial inkjet printing press using a water-based dye ink or water-based pigment ink at a printing speed of 60 m/min or higher.

By this method of producing a printed material, it is possible to produce a printed material in which decrease in printing density is avoided when an industrial inkjet printing press using a water-based dye ink is used, in which a phenomenon in which color densities in the printed part become uneven is suppressed when an industrial inkjet printing press using a water-based pigment ink is used, and in which strike-through of ink is sufficiently suppressed when an industrial inkjet printing press using a water-based dye ink or water-based pigment ink is used.

Mode for Carrying Out the Invention

The coated printing paper for industrial inkjet printing presses of the present invention (hereinafter, also simply referred to as "coated printing paper") will be described below in detail. When used in the present description, "inkjet printing" refers to printing using an industrial inkjet printing press. Furthermore, in the present description, when each component of a composition includes a plurality of materials, an amount of the each component of the composition refers to the total amount of the plurality of materials that are included in the composition unless specifically indicated.

Industrial inkjet printing presses include continuous paper types and cut sheet types according to the difference in the method of transporting paper. The types of ink installed include a water-based dye ink, in which a dye is used for the coloring material, and a water-based pigment ink, in which a pigment is used for the coloring material. In the present invention, there are no particular limitations on the method of transporting paper or on the ink type of the industrial inkjet printing press.

When the image to be printed has both variable information and fixed information, all or a part of the fixed information is preferably printed by using a conventional printing press, such as a gravure printing press, offset printing press, letterpress printing press, flexo printing press, thermal transfer printing press, or toner printing press. In particular, the offset printing press is preferable from the perspectives of quality of printed images and production cost. Printing using a conventional printing press may be before or after the printing using an industrial inkjet printing press.

Examples of the conventional printing presses include gravure printing presses, offset printing presses, letterpress printing presses, flexo printing presses, thermal transfer printing presses, and toner printing presses. Gravure printing presses are printing presses using a method that transfers ink to a material to be printed via a roll-like plate cylinder on which an image has been carved into. Offset printing presses are printing presses using an indirect printing method that transfers ink once to a blanket and then transfers the ink again to a material to be printed. Letterpress printing presses are printing presses using a relief printing method that prints by applying pressure to press an ink provided on relief printing plate to a material to be printed. Flexo printing presses are printing presses using a letterpress method using a resin plate having flexibility and elasticity. Thermal transfer printing presses are printing presses using an ink ribbon of each color and using a method that transfers a coloring material from the ink ribbon to a material to be printed by heat. Toner printing presses are printing presses using an electrophotography method that transfers toner, which is adhered to a charged drum, to a material to be printed utilizing static electricity.

The base paper is paper made, by a conventionally known acidic, neutral, or alkaline method, from a paper stock containing cellulose pulp selected from the group consisting of chemical pulp such as leaf bleached kraft pulp (LBKP) and needle bleached kraft pulp (NBKP), mechanical pulp such as groundwood pulp (GP), pressure groundwood pulp (PGW), refiner mechanical pulp (RMP), thermomechanical pulp (TMP), chemithermomechanical pulp (CTMP), chemimechanical pulp (CMP), and chemigroundwood pulp (CGP), and waste paper pulp such as deinked pulp (DIP) (these may be used alone or in combination of two or more types), and a filler, and, as necessary, various additives such as a sizing agent, fixing agent, retention aid, and cationization agent.

The base paper contains, as a filler, precipitated calcium carbonate which is an aggregate of spindle-like precipitated calcium carbonate having an average minor-axis length of 0.3 μm to 0.4 μm and a ratio of average major-axis length/average minor-axis length of 2.0 to 7.0 and which has an average secondary particle diameter of 3.0 μm to 5.5 μm (hereinafter, also referred to as "chestnut-bur-like precipitated calcium carbonate").

The base paper may contain conventionally known fillers other than the chestnut-bur-like precipitated calcium carbonate to a degree that does not impair the effect of the present invention. Examples of the fillers other than the chestnut-bur-like precipitated calcium carbonate include precipitated calcium carbonate having a needle-like, cubic, or the like shape, or precipitated calcium carbonate in which these are aggregated, ground calcium carbonate, kaolin, and the like. The precipitated calcium carbonate is a calcium carbonate that is produced chemically.

Examples of the method of producing precipitated calcium carbonate include a carbon dioxide gas combination method, soluble salt reaction method, and the like. The carbon dioxide gas combination method is a method of forming precipitated calcium carbonate by reacting carbon dioxide gas with milk of lime which is obtained by dissolving, in water, quicklime obtained by calcining limestone. The soluble salt reaction method is a method of forming precipitated calcium carbonate by reacting milk of lime with a calcium chloride solution and sodium carbonate. Crystal type, size, and shape of the precipitated calcium carbonate can be adjusted by reaction conditions or the like. Examples of crystal type of precipitated calcium carbonate include calcite crystals, aragonite crystals, and the like. The shapes of calcite crystals are typically spindle-like shapes, chestnut-bur-like shapes in which these spindle-like crystals are aggregated, or cubic shapes (cubic or ball-like). The shapes of aragonite crystals are typically bar-like or needle-like shapes. By allowing the base paper to contain chestnut-bur-like precipitated calcium carbonate having a particular particle diameter, the coated printing paper of the present invention can achieve suppression capability of strike-through of ink when an industrial inkjet printing press is used. Although the reason of this is not clear, it is conceived that the special shape of the chestnut-bur-like precipitated calcium carbonate having a particular particle diameter effectively increases scattering of light within the base paper and thus achieves an effect of enhancing the opacity of the base paper.

The content of the chestnut-bur-like precipitated calcium carbonate in the base paper is preferably 80 parts by mass or greater, more preferably 85 parts by mass or greater, and even more preferably 90 parts by mass or greater, based on 100 parts by mass of the total filler contained in the base paper. The reason of this is because the effect of suppressing strike-through of ink when an industrial inkjet printing press is used becomes significant.

The chestnut-bur-like precipitated calcium carbonate is aggregated particles which are formed by aggregating the spindle-like precipitated calcium carbonate having an average minor-axis length of 0.3 μm to 0.4 μm and a ratio of average major-axis length/average minor-axis length of 2.0 to 7.0 and which have an average secondary particle diameter of 3.0 μm to 5.5 μm. The chestnut-bur-like precipitated calcium carbonate is preferably aggregated particles which are formed by aggregating the spindle-like precipitated calcium carbonate having an average minor-axis length of 0.32 μm to 0.36 μm and a ratio of average major-axis length/average minor-axis length of 3.0 to 4.0 and which have an average secondary particle diameter of 3.5 μm to 4.0 μm. Spindle-like shape is a shape which is in a cylindrical particle having thick center part and thin ends at both end parts in a manner that the particle is tapered toward the both end parts. The spindle-like shape is, for example, a shape of a rugby ball. Note that the major-axis length is a length between the both ends that are tapered gradually. The minor-axis length is a diameter of a circle taking a periphery of the thickest part as the circumference. The chestnut-bur-like precipitated calcium carbonate is preferably a substance, in which the spindle-like primary particles of precipitated calcium carbonate are aggregated radially at an end part in the major axis direction to form a chestnut-bur-like aggregated particle, and is also referred to as rosette-type precipitated calcium carbonate. Such chestnut-bur-like precipitated calcium carbonate is commercially available and can be used in the present invention. Examples thereof include TamaPearl 121SA and TamaPearl 221BM manufactured by Okutama Kogyo Co., Ltd., and the like. When the average minor-axis length and/or average secondary particle diameter of the spindle-like precipitated calcium carbonate is not within the range described above or when the ratio of average major-axis length/average minor-axis length is not within the range described above, suppression capability of strike-through of ink when an industrial inkjet printing press is used may not be achieved sufficiently.

The shape, average minor-axis length, and average major-axis length of the primary particles, and shape and average secondary particle diameter of the secondary particles of precipitated calcium carbonate can be determined by image analysis using a scanning electron micrograph. The average minor-axis length and average major-axis length of the primary particles can be determined by taking an electron micrograph using a scanning electron microscope and then observing and measuring randomly chosen 100 primary particles that are confirmed to have spindle-like shapes from the obtained image to calculate. The average secondary particle diameter can be calculated by taking an electron micrograph using a scanning electron microscope and then calculating the particle diameters by estimating areas of 100 secondary particles randomly chosen from the obtained image using spheres having similar areas.

The ash content of the base paper is preferably 15% by mass to 30% by mass, and more preferably 18% by mass to 28% by mass. The reason of this is because, when the ash content is within the range described above, both suppression capability of strike-through of ink when an industrial inkjet printing press is used and strength of the base paper can be made preferable. When the ash content of the base paper is 15% by mass or greater, suppression capability of strike-through of ink tends to be enhanced even more. When the ash content of the base paper is 30% by mass or less, occurrence of troubles such as picking and powder falling tends to be suppressed when printing is performed using an offset printing press.

Note that "ash content" refers to a ratio (% by mass) of the mass of noncombustible materials after subjecting the base paper to a combustion treatment at 500° C. for 1 hour to the absolute dry mass of the base paper prior to the combustion treatment. The ash content can be adjusted by the content of the fillers or the like in the base paper.

The paper stock may appropriately contain other additives, such as a pigment dispersing agent, thickener, fluidity improving agent, defoamer, antifoamer, releasing agent, foaming agent, penetrating agent, coloring dye, coloring pigment, optical brightener, ultraviolet absorbing agent, antioxidant, preservative, fungicide, insolubilizer, wet paper strengthening agent, and dry paper strengthening agent, in the range that does not impair the desired effect of the present invention.

The degree of sizing of the base paper may be any degree of sizing as long as the desired effect of the present invention is not impaired, and can be adjusted by the content of internal sizing agent or by the applied amount of surface sizing agent that is applied to the base paper. The internal sizing agent is, for example, a rosin-based sizing agent for acid paper, and alkenyl succinic anhydride, alkyl ketene dimer, neutral rosin-based sizing agent, or cationic styrene-acrylic sizing agent for neutral paper. Furthermore, the surface sizing agent is, for example, a starch, styrene-acrylic sizing agent, olefin-based sizing agent, styrene-maleic sizing agent, and the like.

The base paper contains at least one material selected from the group consisting of a cationic resin and a water-soluble salt of a polyvalent cation.

The methods of blending at least one material selected from the group consisting of a cationic resin and a water-soluble salt of a polyvalent cation to the base paper includes: (1) a method of papermaking by adding the at least one material into the paper stock, (2) a method of blending by adding the at least one material to a size press liquid using a size press, (3) a method of blending by adding the at least one material to a surface treatment liquid using a coating method other than the size press, such as a curtain coater or air-knife coater, and the like. In the present invention, the method of blending at least one material selected from the group consisting of a cationic resin and a water-soluble salt of a polyvalent cation to the base paper is preferably the method (2) described above. This is because the method (2) can allow the largest amount of the at least one material selected from the group consisting of a cationic resin and a water-soluble salt of a polyvalent cation to be contained uniformly in the vicinity of the surface of the base paper.

The cationic resin is a cationic polymer or a cationic oligomer, and conventionally known cationic resins can be used. Preferable cationic resins are polymers or oligomers containing quaternary ammonium salts or primary to tertiary amines to which a proton is easily coordinated and which dissociate to exhibit cationic characteristics when dissolved in water. Examples of the cationic resin include compounds such as polyethyleneimine, polyvinylpyridine, polyaminesulfone, polydialkylaminoethyl methacrylate, polydialkylaminoethyl acrylate, polydialkylaminoethyl methacrylamide, polydialkylaminoethyl acrylamide, polyepoxyamine, polyamidoamine, dicyandiamide-formalin condensates, polyvinylamine, and polyallylamine, and hydrochlorides of these, as well as polydiallyldimethylammonium chloride and copolymers of monomers such as diallyldimethylammonium chloride and acrylamide, polydiallylmethylamine hydrochloride, polycondensates of aliphatic monoamine or aliphatic polyamine with an epihalohydrin compound, such as dimethylamine-epichlorohydrin polycondensates and diethylenetriamine-epichlorohydrin polycondensates, and the like. The cationic resin is preferably at least one type selected from the group consisting of these. Note that the cationic resin is not limited to these. From the perspective of being easily obtained commercially, the cationic resin is preferably at least one type selected from the group consisting of dimethylamine-epichlorohydrin polycondensates, polyethyleneimine, and polydiallyldimethylammonium chloride, and dimethylamine-epichlorohydrin polycondensates are more preferable. In the present invention, the average molecular weight of the cationic resin is not particularly limited; however, the average molecular weight is preferably in the range of 500 to 20,000.

The water-soluble salt of polyvalent cation is a water-soluble salt containing a metal polyvalent cation. Preferable salts of polyvalent cations are salts containing metal polyvalent cations and capable of dissolving 1% by mass or greater thereof in water at 20° C. Examples of the metal polyvalent cation include divalent cations, such as magnesium, calcium, strontium, barium, nickel, zinc, copper, iron, cobalt, tin, and manganese; trivalent cations, such as aluminum, iron, and chromium; tetravalent cations, such as titanium and zirconium; and complex ions of these. The metal polyvalent cation is preferably at least one type selected from the group consisting of these, and more preferably at least one type selected from the group consisting of divalent cations, and even more preferably at least one type selected from the group consisting of calcium, magnesium, nickel, and zinc. An anion that forms a salt with the metal polyvalent cation may be an anion derived from an inorganic acid or organic acid, and is not particularly limited. Examples of the inorganic acid include hydrochloric acid, nitric acid, phosphoric acid, sulfuric acid, boric acid, hydrofluoric acid, and the like, and the inorganic acid is preferably at least one type selected from the group consisting of these. Examples of the organic acid include formic acid, acetic acid, lactic acid, citric acid, oxalic acid, succinic acid, organic sulfonic acid, and the like, and the organic acid is preferably at least one type selected from the group consisting of these. However, aluminum sulfate which is used as the fixing agent of the sizing agent is excluded.

The water-soluble salt of polyvalent cation is more preferably at least one type selected from the group consisting of calcium salts, such as calcium chloride, calcium formate, calcium nitrate, and calcium acetate, and magnesium salts, such as magnesium sulfate, magnesium nitrate, magnesium formate, and magnesium acetate, and even more preferably at least one type selected from the group consisting of calcium salts, such as calcium chloride, calcium formate, calcium nitrate, and calcium acetate. The reason of this is because unevenness resistance when an industrial inkjet printing press is used becomes even better while offset printability is maintained. From the perspective of costs of chemicals, calcium chloride or calcium nitrate is preferable.

As the method of blending at least one material selected from the group consisting of a cationic resin and a water-soluble salt of a polyvalent cation to the base paper, when "(2) a method of blending by adding the at least one material to a size press liquid using a size press" is employed, a conventionally known surface sizing agent can be added to the size press liquid in addition to the at least one material selected from the group consisting of a cationic resin and a water-soluble salt of a polyvalent cation.

The size press is performed in a conventionally known manner Examples of the size press include an inclined size press, horizontal size press, and a film transfer type such as a rod metering size press, roll metering size press and blade metering size press. The rod metering size press is exemplified by a sym-sizer, optisizer, speed sizer and film press, and the roll metering size press is exemplified by a gate roll coater. Other examples include a Bill blade coater, twin blade coater, Bel-Bapa coater, tab size press, calender size press, and the like. Preferably, the size press is an inclined size press, horizontal size press, gate roll coater, sym-sizer, or film press.

The total content, in terms of dry content, of the at least one material selected from the group consisting of a cationic resin and a water-soluble salt of a polyvalent cation contained in the base paper is preferably 0.2 $g/m^2$ to 8.0 $g/m^2$, and more preferably 0.5 $g/m^2$ to 7.0 $g/m^2$. The reason of this is because, when the total content, in terms of dry content, of the at least one material selected from the group consisting of a cationic resin and a water-soluble salt of a polyvalent cation contained in the base paper is within the range described above, color developing properties, unevenness resistance, or suppression capability of strike-through of ink of the coated printing paper becomes even better.

When "(2) a method of blending by adding the at least one material to a size press liquid using a size press" or "(3) a method of blending by adding the at least one material to a surface treatment liquid using a coating method other than the size press, such as a curtain coater or air-knife coater" is employed, the total content, in terms of dry content, is preferably 0.1 $g/m^2$ to 4.0 $g/m^2$ per one surface. "Total content" refers to content, in terms of dry content, of total amount of all the compounds that are selected from the group consisting of cationic resins and water-soluble salts of polyvalent cations in the base paper. In the case of (2) described above or (3) described above, the total content, in terms of dry content, can be determined from the coated amount, in terms of dry content.

In a preferred aspect of the present invention, the base paper contains at least one material selected from the group consisting of a cationic resin and a water-soluble salt of a polyvalent cation by providing the at least one material selected from the group consisting of a cationic resin and a water-soluble salt of a polyvalent cation to the base paper using a size press, and the total content, in terms of dry content, of the at least one material selected from the group consisting of a cationic resin and a water-soluble salt of a polyvalent cation contained in the base paper is 0.2 $g/m^2$ to 8.0 $g/m^2$.

According to the preferred aspect, the largest amount of the at least one material selected from the group consisting of a cationic resin and a water-soluble salt of a polyvalent cation can be contained uniformly in the vicinity of the surface of the base paper. As a result, color developing properties, unevenness resistance, or suppression capability of strike-through of ink of the coated printing paper becomes even better.

In addition to the at least one material selected from the group consisting of a cationic resin and a water-soluble salt of a polyvalent cation, the base paper may further contain an anionic resin in the range that does not impair the effect of the present invention. The content of the anionic resin contained in the base paper is preferably 2.0 $g/m^2$ or less, and more preferably 1.0 $g/m^2$ or less, and the base paper more preferably contains substantially no anionic resin.

The base paper may be used after being subjected to a calender treatment.

The coated printing paper has a coating layer that contains a pigment and a binder as major components and that is formed on at least one surface of the base paper. Note that "major component" indicates the case where the total amount of the pigment and the binder accounts for the largest proportion in the dry contents constituting the coating layer.

The coating layer contains ground calcium carbonate having the average particle diameter in the range of 0.1 μm to 0.28 μm as a pigment. The average particle diameter of the ground calcium carbonate is preferably 0.12 μm to 0.28 μm, and more preferably 0.12 μm to 0.23 μm.

The ground calcium carbonate preferably contains no particles having the particle diameter of greater than 1.5 μm. The reason of this is because unevenness resistance during inkjet printing d becomes even better.

The average particle diameter of the ground calcium carbonate is an average particle diameter based on the particle size distribution measurement in terms of volume by a laser diffraction/scattering method or dynamic light scattering method. In the case of single-particles, the average particle diameter is an average particle diameter of the single-particles, and in the case where aggregated particles such as secondary particles are formed, the average particle diameter is an average particle diameter of the aggregated particles. The average particle diameter can be measured by, for example, using a laser diffraction/scattering particle size distribution measuring device, Microtrac MT3300EXII, manufactured by Nikkiso Co., Ltd. When the particle size distribution and average particle diameter of the ground calcium carbonate are calculated from the coated printing paper, for example, the particle size distribution and average particle diameter can be calculated by taking an electron micrograph of the coated printing paper surface using a scanning electron microscope, calculating the particle diameters by estimating areas of the taken particles using spheres having similar areas, and then measuring 100 particles present in the obtained image.

The coating layer of the coated printing paper may contain conventionally known pigments other than the ground calcium carbonate. Examples of such conventionally known pigments include varieties of kaolin, clay, talc, precipitated calcium carbonate, satin white, lithopone, titanium oxide, zinc oxide, synthetic silica, alumina, aluminum hydroxide, plastic pigments, organic pigments, and the like.

The content of the ground calcium carbonate having an average particle diameter of 0.1 μm to 0.28 μm in the coating layer is 60 parts by mass or greater, preferably 70 parts by mass or greater, and more preferably 80 parts by mass or greater, based on 100 parts by mass of the total pigment contained in the coating layer. The reason of this is because even better color developing properties and unevenness resistance can be achieved when an industrial inkjet printing press is used.

The ground calcium carbonate having a particular average particle diameter can be produced by the following method, for example. First, a preliminary dispersed slurry of ground calcium carbonate is prepared by dispersing a powder, obtained by dry-crushing natural limestone, in water or an aqueous solution to which a dispersing agent has been added. The preliminary dispersed slurry prepared in this manner is then further wet-crushed using a bead mill or the like. Here, the natural limestone can also be wet-crushed directly. However, dry crushing is preferably performed in advance prior to wet crushing from the perspective of productivity. During dry crushing, the limestone is crushed to a particle diameter of 40 mm or less, and preferably to an average particle diameter of approximately 2 μm to 2 mm. During wet crushing, the particle diameter is preferably adjusted by granulating the particle size at an intermediate stage. Granulation of the particle size can be performed using a commercially available granulating machine.

Next, an organic dispersing agent is preferably applied to the surface of the crushed limestone described above. Although this can be performed by various methods, it is preferably performed by a method including wet crushing the dry-crushed limestone in the presence of an organic dispersing agent. Specifically, an aqueous medium is added to the limestone in a manner that the mass ratio of limestone/aqueous medium (preferably water) is 30/70 to 85/15, and preferably 60/40 to 80/20, followed by addition of the organic dispersing agent thereto. Examples of organic dispersing agents include low molecular weight or high molecular weight water-soluble anionic surfactants having a carboxylate, sulfate, sulfonate, or phosphate as a functional group thereof, and polyethylene glycol-based or polyhydric alcohol-based nonionic surfactants. The water-soluble anionic surfactant as the organic dispersing agent is particularly preferably a polyacrylic acid-based organic dispersing agent having polyacrylic acid. These organic dispersing agents are commercially available from San Nopco Ltd., Toagosei Co., Ltd., Kao Corporation, or the like, and these can be used in the present invention. Although there are no particular limitations on the amount of organic dispersing agent used, the amount, in terms of solid content, is preferably in the range of 0.3 part by mass to 3.5 parts by mass, and more preferably in the range of 0.5 part by mass to 3 parts by mass, based on 100 parts by mass of the ground calcium carbonate. The obtained preliminary dispersed slurry is wet-crushed using a conventionally known method. Alternatively, an aqueous medium, obtained by preliminarily dissolving an organic dispersing agent in an amount within the range described above, is mixed with limestone and then wet-crushed using a conventionally known method. Wet crushing can be performed in batches or continuously with an apparatus, including a mill using a crushing medium such as a sand mill, attritor, or ball mill, and the like. By performing wet crushing in this manner, ground calcium carbonate having an average particle diameter of 0.1 μm to 0.28 μm can be obtained. Note that the method to obtain ground calcium carbonate having a particular average particle diameter is not limited to the methods described above.

Examples of the conventionally known binder used in the coating layer of the coated printing paper include polyacrylate-based such as sodium polyacrylate and polyacrylamide, polyvinylacetate-based, varieties of copolymer latex such as styrene-butadiene copolymers and ethylene-vinylacetate, polyvinyl alcohol, modified polyvinyl alcohol, polyethylene oxide, formalin resins such as urea resins and melamine resins, water-soluble synthetic substances such as polyethyleneimine, polyamide polyamine, and epichlorohydrin, and at least one type selected from the group consisting of these is preferable. Examples thereof further include starches refined from natural plants, hydroxyethylated starches, oxidized starches, etherified starches, phosphoric acid esterified starches, enzymatically modified starches, and cold-water soluble starches obtained by flash-drying these, natural polysaccharides, such as dextrin, mannan, chitosan, arabinogalactan, glycogen, inulin, pectin, hyaluronic acid, carboxymethyl cellulose, and hydroxyethyl cellulose, or oligomers of these, and modified substances of these, and at least one type selected from the group consisting of these is preferable. Examples thereof also include natural proteins such as casein, gelatin, soybean protein, and collagen, or modified substances of these, as well as synthetic polymers and oligomers such as polylactic acid and peptide. These may be used alone or as a combination. Furthermore, the binder may be used after being cation-modified. Among these, the binder is preferably at least one type selected from the group consisting of water-soluble synthetic substances and natural polysaccharides. Since, when the binder is excessively contained relative to the amount of pigment, image smudge may occur during inkjet printing, the content of the binder in the coating layer is preferably 3 parts by mass to 30 parts by mass, and more preferably 5 parts by mass to 25 parts by mass, based on 100 parts by mass of the total pigment contained in the coating layer, in terms of dry content.

In addition to the ground calcium carbonate and the binder, the coating layer of the coated printing paper may contain, as necessary, typically used conventionally known various auxiliaries, such as other pigments, pigment dispersing agents, thickeners, defoamer, antifoamer, foaming agents, releasing agents, penetrating agents, humectants, thermal gelling agents, lubricants, dyes, optical brightener, and insolubilizers.

The coating layer of the coated printing paper can be obtained by coating and drying the coating composition for forming the coating layer on the base paper. The method of coating the coating composition on the base paper is not particularly limited, and typically used coating apparatus can be used. Examples of the coating apparatus include roll coaters, air-knife coaters, bar coaters, various blade coaters such as a rod blade coater, short-dwell coaters, curtain coaters, and the like. The method of drying is not particularly limited, and typically used drying apparatus can be used. Examples of the drying apparatus include hot air dryers such as a linear tunnel dryer, arch dryer, air loop dryer, and sine curve air float dryer, infrared heating dryers, dryers utilizing microwave, and the like.

The coated amount of the coating layer is preferably 6.0 $g/m^2$ to 20.0 $g/m^2$, and more preferably 8.0 $g/m^2$ to 18.0 $g/m^2$, per one surface. By setting the coated amount to be within this range, both an offset printing press and an ink-jet printing press can be used for printing. In the present invention, the coated amount of the coating layer indicates the amount in terms of dry content.

The coated printing paper can be used after coating and drying the coating composition; however, the coated printing paper also may be used after smoothing the surface as necessary using a machine calender, soft nip calender, super calender, multi-step calender, multi-nip calender, or the like.

However, if excessive calender treatment is performed for the smoothing, voids in the coated printing paper are crushed, and as a result, strike-through of ink during inkjet printing is worsen. Therefore, moderate calender treatment is preferable.

On the coated surface of the coating layer, 75° glossiness stipulated in JIS Z8741 is preferably 30% or greater, and more preferably 35% or greater. When the 75° glossiness is within this range, the coated printing paper can have similar texture as those of coated printing paper such as CWF matte coated paper and CWF gloss coated paper.

The glossiness of the coating layer can be controlled by the average particle diameter of the ground calcium carbonate contained in the coating layer. The glossiness of the coating layer can be also suppressed by blending a conventionally known matting agent in the coating layer. The glossiness of the coating layer can be also enhanced by a method in which an organic pigment is added to the coating layer, or by a method in which a calender treatment is performed using a machine calender, soft nip calender, super calender, multi-step calender, multi-nip calender, or the like.

The coating layer may be provided on the both sides of the base paper to be treated. Providing the coating layer on the both sides is preferable since printing on the both sides using a printing press is made possible.

The basis weight of the coated printing paper is preferably 130 g/m$^2$ or less. The reason of this is because, when the basis weight is 130 g/m$^2$ or less, suppression capability of strike-through of ink according to the present invention is exhibited significantly. Furthermore, from the perspectives of uses in commercial printing field, such as for invoices and transaction descriptions, as well as advertising leaflets and direct mails, or so-called transpromo which is a combination of these, the basis weight of the coated printing paper is more preferably 90 g/m$^2$ to 130 g/m$^2$, and even more preferably 100 g/m$^2$ to 128 g/m$^2$.

The coated printing paper of the present invention can be used for offset printing and/or inkjet printing and can obtain printed images having excellent image quality and durability. The coated printing paper of the present invention can be suitably used for a rotary industrial inkjet printing press demonstrating printing speeds of 60 m/min or higher and exceeding 120 m/min in the case of high-speed printing, and can obtain printed images having excellent image quality and durability. The coated printing paper of the present invention can be also used for, in addition to offset printing, gravure printing, wet and dry electrophotography, and other printing methods, without particular limitations. Furthermore, in addition to ink-jet printing presses, the coated printing paper of the present invention can be also used for commercially available inkjet printers that are suitable for SOHO.

Another embodiment of the present invention is a method of producing a printed material, the method comprising a step of preparing the coated printing paper for industrial inkjet printing presses described above, and a step of forming printed image by an industrial inkjet printing press using a water-based dye ink or water-based pigment ink to the coated printing paper for industrial inkjet printing presses at a printing speed of 60 m/min or higher. By this method of producing a printed material, it is possible to produce a printed material in which decrease in printing density is avoided when an industrial inkjet printing press using a water-based dye ink is used, in which a phenomenon in which color densities in the printed part become uneven is suppressed when an industrial inkjet printing press using a water-based pigment ink is used, and in which strike-through of ink is sufficiently suppressed when an industrial inkjet printing press using a water-based dye ink or water-based pigment ink is used.

EXAMPLES

The present invention is described below more specifically using examples, but the present invention is not limited to the following examples provided the gist thereof is not exceeded. Furthermore, "part" and "%" in examples refer to "part by mass" and "% by mass" in terms of dry content or actual component unless otherwise noted. Furthermore, the coated amount is the amount in terms of dry content.

<Measurements of Shapes, Average Minor-Axis Length, and Average Major-Axis Length of Primary Particles, and Shapes and Average Particle Diameter of Secondary Particles of Fillers>

The shapes, average minor-axis length, and average major-axis length of primary particles, and shapes and average particle diameter of secondary particles of fillers described below were determined from photographed images taken using a scanning electron microscope.

(Production of Base Paper)

<Base Paper 1>

To pulp slurry composed of 100 parts of LBKP having a freeness of 400 mL csf, 22 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 1. At this time, the ash content was 20%.

<Base Paper 2>

To pulp slurry composed of 100 parts of LBKP having a freeness of 400 mL csf, 22 parts of TamaPearl TP-221BM (primary particles: spindle-like precipitated calcium carbonate having an average minor-axis length of 0.32 μm and a ratio of average major-axis length/average minor-axis length of 3.0; secondary particles: chestnut-bur-like precipitated calcium carbonate having an average particle diameter of 4.0 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 2. At this time, the ash content was 20%.

<Base Paper 3>

To pulp slurry composed of 100 parts of LBKP having a freeness of 400 mL csf, 22 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of calcium chloride, per one surface, were adhered using a size press device, and then a machine calender treatment was performed to produce base paper 3. At this time, the ash content was 20%.

<Base Paper 4>

To pulp slurry composed of 100 parts of LBKP having a freeness of 400 mL csf, 22 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of calcium nitrate, per one surface, were adhered using a size press device, and then a machine calender treatment was performed to produce base paper 4. At this time, the ash content was 20%.

<Base Paper 5>

To pulp slurry composed of 100 parts of LBKP having a freeness of 400 mL csf, 22 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch, 0.75 g/m$^2$ of dimethylamine-epichlorohydrin polycondensate (Jetfix 36N, manufactured by Satoda Chemical Industrial Co., Ltd.), and 0.75 g/m$^2$ of calcium nitrate, per one surface, were adhered using a size press device, and then a machine calender treatment was performed to produce base paper 5. At this time, the ash content was 20%.

<Base Paper 6>

To pulp slurry composed of 100 parts of LBKP having a freeness of 400 mL csf, 22 parts of TamaPearl TP-121 SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 0.08 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 6. At this time, the ash content was 20%.

<Base Paper 7>

To pulp slurry composed of 100 parts of LBKP having a freeness of 400 mL csf, 22 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 0.12 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 7. At this time, the ash content was 20%.

<Base Paper 8>

To pulp slurry composed of 100 parts of LBKP having a freeness of 400 mL csf, 22 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 3.8 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 8. At this time, the ash content was 20%.

<Base Paper 9>

To pulp slurry composed of 100 parts of LBKP having a freeness of 400 mL csf, 22 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 4.2 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 9. At this time, the ash content was 20%.

<Base Paper 10>

To pulp slurry composed of 100 parts of LBKP having a freeness of 400 mL csf, 22 parts of TamaPearl TP-NPF (primary particles: spindle-like precipitated calcium carbonate having an average minor-axis length of 0.12 μm and a ratio of average major-axis length/average minor-axis length of 4.0; secondary particles: chestnut-bur-like precipitated calcium carbonate having an average particle diameter of 3.9 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 10. At this time, the ash content was 20%.

<Base Paper 11>

To pulp slurry composed of 100 parts of LBKP having a freeness of 400 mL csf, 23 parts of TamaPearl TP-121MS (primary particles: spindle-like precipitated calcium carbonate having an average minor-axis length of 0.47 μm and a ratio of average major-axis length/average minor-axis length of 3.0; secondary particles: chestnut-bur-like precipitated calcium carbonate having an average particle diameter of 2.3 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 11. At this time, the ash content was 20%.

<Base Paper 12>

To pulp slurry composed of 100 parts of LBKP having a freeness of 400 mL csf, 22 parts of TamaPearl TP-121S (primary particles: spindle-like precipitated calcium carbonate having an average minor-axis length of 0.63 μm and a ratio of average major-axis length/average minor-axis length of 4.0; secondary particles: chestnut-bur-like precipitated calcium carbonate having an average particle diameter of 4.3 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 12. At this time, the ash content was 20%.

<Base Paper 13>

To pulp slurry composed of 100 parts of LBKP having a freeness of 400 mL csf, 23 parts of TamaPearl TP-221GS (primary particles: spindle-like precipitated calcium carbonate having an average minor-axis length of 0.29 μm and a ratio of average major-axis length/average minor-axis length of 1.8; secondary particles: chestnut-bur-like precipitated calcium carbonate having an average particle diameter of 0.81 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 13. At this time, the ash content was 20%.

<Base Paper 14>

To pulp slurry composed of 100 parts of LBKP having a freeness of 400 mL csf, 23 parts of TamaPearl TP-123FS (primary particles: needle-like precipitated calcium carbonate having an average minor-axis length of 0.22 μm and a ratio of average major-axis length/average minor-axis length of 7.2; secondary particles: chestnut-bur-like precipitated calcium carbonate having an average particle diameter of 3.8 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 14. At this time, the ash content was 20%.

<Base Paper 15>

To pulp slurry composed of 100 parts of LBKP having a freeness of 400 mL csf, 23 parts of TamaPearl TP-221F (spindle-like precipitated calcium carbonate having an average minor-axis length of 0.26 μm and a ratio of average major-axis length/average minor-axis length of 2.0; secondary particles were not formed; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 15. At this time, the ash content was 20%.

<Base Paper 16>

To pulp slurry composed of 100 parts of LBKP having a freeness of 400 mL csf, 22 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch, per one surface, was adhered using a size press device, and then a machine calender treatment was performed to produce base paper 16. At this time, the ash content was 20%.

<Base Paper 17>

To pulp slurry composed of 100 parts of LBKP having a freeness of 400 mL csf, 21 parts of TamaPearl TP-121 SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of sodium chloride, per one surface, were adhered using a size press device, and then a machine calender treatment was performed to produce base paper 17. At this time, the ash content was 20%.

<Base Paper 18>

To pulp slurry composed of 100 parts of LBKP having a freeness of 400 mL csf, 23 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of anionic acrylic resin (Voncoat AN-680, manufactured by DIC Corporation), per one surface, were adhered using a size press device, and then a machine calender treatment was performed to produce base paper 18. At this time, the ash content was 20%.

<Base Paper 19>

To pulp slurry composed of 100 parts of LBKP having a freeness of 400 mL csf, 17.6 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm) as a filler, 4.4 parts of kaolin (New Clay; average particle diameter: 3.9 μm; manufactured by Engelhard Corporation) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 19. At this time, the ash content was 20%.

<Base Paper 20>

To pulp slurry composed of 100 parts of LBKP having a freeness of 400 mL csf, 22 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm) as a filler, 0.8 part of amphoteric starch, 0.8 part of aluminum sulfate, 0.5 part of alkyl ketene dimer-based sizing agent (Sizepine K903, manufactured by Arakawa Chemical Industries, Ltd.), and 5 parts of dimethylamine-epichlorohydrin polycondensate (Jetfix 36N, manufactured by Satoda Chemical Industrial Co., Ltd.) were added to make paper using the Fourdrinier machine. Thereto, 1.5 g/m$^2$ of phosphoric acid esterified starch, per one surface, was adhered using a size press device, and then a machine calender treatment was performed to produce base paper 20. At this time, the ash content was 20%.

<Base Paper 21>

On both surfaces of the base paper 16 described above, dimethylamine-epichlorohydrin polycondensate (Jetfix 36N, manufactured by Satoda Chemical Industrial Co., Ltd.) was coated using an air-knife coater in a manner that the coated amount was 1.5 g/m$^2$ per one surface and dried using a hot air dryer. After the drying, a calender treatment was performed using a soft calender to produce base paper 21.

<Base Paper 22>

To pulp slurry composed of 100 parts of LBKP having a freeness of 400 mL csf, 21 parts of Tunex-E (primary particles: spindle-like precipitated calcium carbonate having an average minor-axis length of 0.1 μm and a ratio of average major-axis length/average minor-axis length of 3.0; secondary particles: chestnut-bur-like precipitated calcium carbonate having an average particle diameter of 5.6 μm; manufactured by Shiraishi Calcium Kaisha, Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of dimethylamine-epichlorohydrin polycondensate (Jetfix 36N, manufactured by Satoda Chemical Industrial Co., Ltd.), per one surface, were adhered using a size press device, and then a machine calender treatment was performed to produce base paper 22. At this time, the ash content was 20%.

<Base Paper 23>

To pulp slurry composed of 100 parts of LBKP having a freeness of 400 mL csf, 22 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5 μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of polyethyleneimine (Epomin, manufactured by Nippon Shokubai Co., Ltd.), per one surface, were adhered using a size press device, and then a machine calender treatment was performed to produce base paper 23. At this time, the ash content was 20%.

<Base Paper 24>

To pulp slurry composed of 100 parts of LBKP having a freeness of 400 mL csf, 22 parts of TamaPearl TP-121SA (primary particles: spindle-like precipitated calcium carbonate having an average minor-axis length of 0.36 μm and a ratio of average major-axis length/average minor-axis length of 4.0; secondary particles: chestnut-bur-like precipitated calcium carbonate having an average particle diameter of 3.5

μm; manufactured by Okutama Kogyo Co., Ltd.) as a filler, 0.8 part of amphoteric starch, 0.8 part of aluminum sulfate, and 0.5 part of alkyl ketene dimer-based sizing agent (Sizepine K903, manufactured by Arakawa Chemical Industries, Ltd.) were added to make paper using the Fourdrinier machine. Thereto, 1.5 g/m$^2$ of phosphoric acid esterified starch and 1.5 g/m$^2$ of magnesium sulfate (manufactured by Wako Pure Chemical Industries, Ltd.), per one surface, were adhered using a size press device, and then a machine calender treatment was performed to produce base paper 24. At this time, the ash content was 20%.

<Measurement of Average Particle Diameter of Ground Calcium Carbonate>

The average particle diameters determined from photographed images of scanning electron microscope are shown in Table 1.

<Preparation of Ground Calcium Carbonate>

As ground calcium carbonate, natural limestone was roughly crushed to an average particle diameter of approximately 30 μm using a jaw crusher, a hammer crusher, and a roller mill to regulate the particle size, and then water and a commercially available polyacrylic acid-based dispersing agent were added thereto and stirred to form a preliminary dispersed slurry having a solid content of approximately 75% by mass. This preliminary dispersed slurry was treated using a wet crusher manufactured by Ashizawa Finetech Ltd. (horizontal type, dimension of cylindrical crushing chamber: diameter: approximately 0.5 m; length: approximately 1.3 m). Beads having a diameter of approximately 0.2 mm made of zirconia were used. Packing fractions of the beads were varied in the range of 80 vol. % to 85 vol. %. Flow rates were set at approximately 15 L/min, and numbers of passing were varied. By the operations described above, ground calcium carbonate having various average particle diameters was prepared.

<Preparation of Coating Composition>

The coating composition was prepared as described below.

Pigment: types and the number of parts compounded are shown in Table 1

Styrene-butadiene copolymer latex (JSR-2605G, manufactured by JSR Corporation): 10 parts Phosphoric acid esterified starch (MS#4600, manufactured by Nihon Shokuhin Kako Co., Ltd.): 10 parts The coating composition was prepared to have a concentration of 48% by blending the components described above, and mixing with water and dispersing in water.

TABLE 1

| | | Pigment | | | | | Printability using offset printing press | Printability using industrial inkjet printing press | | | |
|---|---|---|---|---|---|---|---|---|---|---|---|
| | | | | | | | | Dye ink | | Pigment ink | |
| | Type of base paper | Average particle diameter of ground calcium carbonate (μm) | Proportion (part) | Other pigment | Proportion (part) | Opacity (%) | | Color developing properties | Strike-through of ink | Unevenness resistance | Strike-through of ink |
| Example 1 | Base paper 1 | 0.2 | 100 | None | 0 | | 4 | 5 | 5 | 4 | 4 |
| Example 2 | Base paper 1 | 0.12 | 100 | None | 0 | 95.3 | 4 | 5 | 5 | 4 | 4 |
| Example 3 | Base paper 1 | 0.28 | 100 | None | 0 | 95.7 | 4 | 4 | 5 | 4 | 4 |
| Example 4 | Base paper 1 | 0.23 | 100 | None | 0 | 95.6 | 4 | 5 | 5 | 4 | 4 |
| Example 5 | Base paper 1 | 0.19 | 100 | None | 0 | 95.4 | 4 | 5 | 5 | 4 | 4 |
| Example 6 | Base paper 19 | 0.2 | 100 | None | 0 | 95.3 | 4 | 5 | 4 | 4 | 4 |
| Example 7 | Base paper 2 | 0.2 | 100 | None | 0 | 95.7 | 4 | 5 | 5 | 4 | 4 |
| Example 8 | Base paper 3 | 0.2 | 100 | None | 0 | 95.4 | 5 | 5 | 5 | 5 | 5 |
| Example 9 | Base paper 4 | 0.2 | 100 | None | 0 | 95.4 | 5 | 5 | 5 | 5 | 5 |
| Example 10 | Base paper 5 | 0.2 | 100 | None | 0 | 95.5 | 5 | 5 | 5 | 5 | 5 |
| Example 11 | Base paper 23 | 0.2 | 100 | None | 0 | 95.4 | 4 | 4 | 4 | 4 | 4 |
| Example 12 | Base paper 24 | 0.2 | 100 | None | 0 | 95.5 | 4 | 4 | 4 | 4 | 4 |
| Example 13 | Base paper 1 | 0.2 | 60 | Kaolin | 40 | 95.7 | 3 | 3 | 4 | 3 | 5 |
| Example 14 | Base paper 1 | 0.2 | 80 | Kaolin | 20 | 95.6 | 4 | 4 | 5 | 4 | 4 |
| Example 15 | Base paper 1 | 0.2 | 60 | Precipitated calcium carbonate | 40 | 95.6 | 4 | 3 | 4 | 3 | 5 |
| Example 16 | Base paper 6 | 0.2 | 100 | None | 0 | 95.7 | 5 | 3 | 3 | 3 | 3 |
| Example 17 | Base paper 7 | 0.2 | 100 | None | 0 | 95.7 | 5 | 4 | 4 | 4 | 4 |
| Example 18 | Base paper 8 | 0.2 | 100 | None | 0 | 95.2 | 4 | 5 | 5 | 4 | 5 |
| Example 19 | Base paper 9 | 0.2 | 100 | None | 0 | 95.2 | 4 | 4 | 5 | 3 | 5 |
| Example 20 | Base paper 4 | 0.2 | 60 | Kaolin | 40 | 95.6 | 5 | 3 | 4 | 3 | 5 |
| Example 21 | Base paper 4 | 0.2 | 60 | Precipitated calcium carbonate | 40 | 95.5 | 4 | 3 | 4 | 4 | 5 |
| Example 22 | Base paper 20 | 0.2 | 100 | None | 0 | 95.3 | 4 | 4 | 4 | 3 | 3 |
| Example 23 | Base paper 21 | 0.2 | 100 | None | 0 | 95.4 | 4 | 4 | 4 | 4 | 4 |
| Comparative Example 1 | Base paper 10 | 0.2 | 100 | None | 0 | 93.8 | 4 | 5 | 2 | 4 | 2 |
| Comparative Example 2 | Base paper 11 | 0.2 | 100 | None | 0 | 93.5 | 4 | 5 | 2 | 3 | 2 |
| Comparative Example 3 | Base paper 12 | 0.2 | 100 | None | 0 | 93.3 | 4 | 5 | 2 | 3 | 1 |
| Comparative Example 4 | Base paper 13 | 0.2 | 100 | None | 0 | 93.7 | 3 | 5 | 2 | 3 | 2 |
| Comparative Example 5 | Base paper 14 | 0.2 | 100 | None | 0 | 93.8 | 4 | 5 | 2 | 3 | 2 |

TABLE 1-continued

| | | Pigment | | | | | Print-ability using offset printing press | Printability using industrial inkjet printing press | | | |
|---|---|---|---|---|---|---|---|---|---|---|---|
| | | | | | | | | Dye ink | | Pigment ink | |
| | Type of base paper | Average particle diameter of ground calcium carbonate (μm) | Pro-portion (part) | Other pigment | Pro-portion (part) | Opacity (%) | | Color developing properties | Strike-through of ink | Une-venness resistance | Strike-through of ink |
| Comparative Example 6 | Base paper 15 | 0.2 | 100 | None | 0 | 93.2 | 3 | 5 | 1 | 2 | 1 |
| Comparative Example 7 | Base paper 22 | 0.2 | 100 | None | 0 | 93.6 | 4 | 5 | 1 | 3 | 1 |
| Comparative Example 8 | Base paper 1 | 0.31 | 100 | None | 0 | 95.6 | 4 | 2 | 3 | 2 | 2 |
| Comparative Example 9 | Base paper 1 | 0.5 | 100 | None | 0 | 95.7 | 4 | 2 | 3 | 1 | 3 |
| Comparative Example 10 | Base paper 1 | 0.07 | 100 | None | 0 | 94.3 | 3 | 4 | 2 | 2 | 1 |
| Comparative Example 11 | Base paper 1 | 0.2 | 50 | Kaolin | 50 | 95.7 | 3 | 2 | 3 | 2 | 3 |
| Comparative Example 12 | Base paper 1 | — | — | Synthetic silica A | 100 | 95.1 | 1 | 2 | 2 | 1 | 1 |
| Comparative Example 13 | Base paper 1 | — | — | Synthetic silica B | 100 | 95.2 | 1 | 4 | 4 | 2 | 4 |
| Comparative Example 14 | Base paper 16 | 0.2 | 100 | None | 0 | 95.4 | 5 | 1 | 1 | 1 | 1 |
| Comparative Example 15 | Base paper 17 | 0.2 | 100 | None | 0 | 95.4 | 3 | 2 | 1 | 1 | 1 |
| Comparative Example 16 | Base paper 18 | 0.2 | 100 | None | 0 | 95.6 | 5 | 1 | 1 | 1 | 1 |

The other pigments shown in Table 1 are as described below.

Precipitated calcium carbonate (TP123; average particle diameter: 0.63 μm; manufactured by Okutama Kogyo Co., Ltd.)

Kaolin (HG90; average particle diameter: 0.19 μm; manufactured by J.M. Huber Corporation)

Synthetic silica A (Colloidal Silica MP-2040; average particle diameter: 0.2 μm; manufactured by Nissan Chemical Industries, Ltd.)

Synthetic silica B (Fineseal X-37; average particle diameter: 2.7 μm; manufactured by Tokuyama Corporation)

The coated printing paper of Examples and Comparative Examples were produced by the procedure described below.

<Production of Coated Printing Paper>

On the both surfaces of a base paper, a coating composition was coated using a blade coater and dried. Then, a calender treatment was performed to produce coated printing paper. The coated amount was 12 g/m$^2$ per one surface.

Evaluation of each item was performed by a method described below for the coated printing paper of each of Examples and Comparative Examples obtained by the procedure described above. Results are shown in Table 1.

<Measurement of Opacity>

The opacity of the coated printing paper was measured using a measurement method of opacity stipulated in JIS P8149 (IS02471).

<Printability when Offset Printing Press is Used>

Printing of 6000 m was performed using an offset form rotary press, manufactured by Miyakoshi Printing Machinery Co., Ltd., under conditions: a printing speed of 150 m/min, using T & K Toka UV Best Cure Black and Bronze Red Ink for the ink, and two UV irradiation sources at 8 kW. After the printing, occurrence of blanket piling and conditions of printed samples were visually evaluated. In the present invention, coated printing paper exhibiting suitable printability when an offset printing press is used has the score of 3 to 5.

5: Extremely good

4: Good

3: No practical problems occurred

2: Poor

1: Extremely poor

<Color Developing Properties when Industrial Inkjet Printing Press is Used (Water-Based Dye Ink)>

Printing of 6000 m of image to be evaluated was performed using an industrial inkjet printing press, MJP20C, manufactured by Miyakoshi Printing Machinery Co., Ltd. using a water-based dye ink at 150 m/min. Printing was performed in a manner that 2 cm×2 cm square solid patterns were recorded in a single continuous row with seven colors, namely, black, cyan, magenta, yellow, and superimposed colors (red, green, blue) created by a combination of two colors out of the above three color inks except black. The color developing properties of the printed solid pattern section of each color was visually evaluated from the perspectives of color densities and vividness of the color. In the present invention, coated printing paper exhibiting excellent color developing properties has the score of 3 to 5.

5: Both color densities and vividness of the color were excellent

4: Color densities or vividness of the color was poor compared to "5", but the color densities and vividness of the color were still good 3: Color densities and vividness of the color had no practical problems 2: Color densities or vividness of the color was poor compared to "3", and the color densities and vividness of the color had practical problems 1: Both color densities and vividness of the color were poor and had practical problems <Unevenness Resistance when Using Industrial Inkjet Printing Press (Water-Based Pigment Ink)>

Printing of 6000 m of image to be evaluated was performed using an industrial inkjet printing press, Prosper 5000XL Press, manufactured by Eastman Kodak Co. using a water-based pigment ink at 75 m/min. Printing was performed in a manner that 3 cm×3 cm square solid patterns were recorded in a single continuous row with seven colors, namely, black, cyan, magenta, yellow, and superimposed colors (red, green, blue) created by a combination of two colors out of the above three color inks except black. The evenness of color densities of the printed solid pattern section of each color was visually evaluated. In the present invention, coated printing paper exhibiting excellent unevenness resistance has the score of 3 to 5.

5: Color densities were even

4: Densities were slightly uneven depending on color

3: Color densities were slightly uneven

2: Color densities were partially uneven

1: Color densities were uneven for the entire printed part

<Suppression Capability of Strike-Through of Ink when Industrial Inkjet Printing Press is Used>

For the water-based dye ink, printing of 6000 m of image to be evaluated was performed using an industrial inkjet printing press, MJP20C, manufactured by Miyakoshi Printing Machinery Co., Ltd. at 150 m/min, and for the water-based pigment ink, printing of 6000 m of image to be evaluated was performed using an industrial inkjet printing press, Prosper 5000XL Press, manufactured by Eastman Kodak Co. at 75 m/min. Printing was performed in a manner that 10 cm×10 cm square solid patterns were recorded in black. Brightness was measured from the surface that is on the other face relative to the black printed solid pattern section, using a method of measuring brightness stipulated in JIS P8148. The strike-through of ink of the coated printing paper was evaluated by "brightness of white part without print (optical %)"-"brightness of black printed solid pattern section (optical %)". The measurement of brightness was performed using the PF-10 manufactured by Nippon Denshoku Industries Co., Ltd. by placing one sheet of sample on a standard plate under UV cut conditions. In the present invention, coated printing paper exhibiting excellent suppression capability of strike-through of ink has the score of 3 to 5.

5: Less than 10 optical %

4: 10 optical % or greater but less than 13 optical %

3: 13 optical % or greater but less than 16 optical %

2: 16 optical % or greater but less than 19 optical %

1: 19 optical % or greater

From Table 1, it was found that the coated printing paper of each of the Examples, which were the present invention, has good offset printability and achieves color developing properties and suppression capability of strike-through of ink when an industrial inkjet printing press using a water-based dye ink is used, and unevenness resistance and suppression capability of strike-through of ink when an industrial inkjet printing press using a water-based pigment ink is used.

On the other hand, from Table 1, each of the Comparative Examples that did not satisfy the requirements of the present invention could not achieve the effect of the present invention.

The disclosure of Japanese Patent Application No. 2013-207213 (date of application: Oct. 2, 2013) is incorporated herein by reference in its entirety.

All publications, patent applications, and technical standards indicated in the present description are incorporated herein by reference to the same extent as if such individual publication, patent application, or technical standard was specifically and individually indicated to be incorporated by reference.

The invention claimed is:

1. Coated printing paper for an industrial inkjet printing press, comprising: base paper, and a coating layer formed on at least one surface of the base paper, the coating layer containing a pigment and a binder as major components; wherein the base paper contains precipitated calcium carbonate which is an aggregate of spindle-like precipitated calcium carbonate having an average minor-axis length of 0.3 μm to 0.4 μm and a ratio of average major-axis length/average minor-axis length of 2.0 to 7.0 and which has an average secondary particle diameter of 3.0 μm to 5.5 μm; and at least one material selected from the group consisting of a cationic resin and a water-soluble salt of a polyvalent cation; and the coating layer contains ground calcium carbonate having an average particle diameter of 0.1 μm to 0.28 μm in an amount of 60 parts by mass or greater based on 100 parts by mass of the total pigment contained in the coating layer.

2. The coated printing paper for an industrial inkjet printing press according to claim 1, wherein the precipitated calcium carbonate having the average secondary particle diameter of 3.0 μm to 5.5 μm contained in the base paper is an aggregate which has aggregated in a radial shape at an end portion in a major axis direction of the spindle-like precipitated calcium carbonate.

3. The coated printing paper for an industrial inkjet printing press according to claim 1, wherein the base paper contains 80 parts by mass or greater of the precipitated calcium carbonate having the average secondary particle diameter of 3.0 μm to 5.5 μm based on 100 parts by mass of total filler contained in the base paper.

4. The coated printing paper for an industrial inkjet printing press according to claim 1, wherein the total content, in terms of dry content, of the at least one material selected from the group consisting of a cationic resin and a water-soluble salt of a polyvalent cation contained in the base paper is 0.2 $g/m^2$ to 8.0 $g/m^2$.

5. The coated printing paper for an industrial inkjet printing press according to claim 1, wherein the at least one material selected from the group consisting of a cationic resin and a water-soluble salt of a polyvalent cation is added to the base paper using a size press.

6. The coated printing paper for an industrial inkjet printing press according to claim 2, wherein the base paper contains 80 parts by mass or greater of the precipitated calcium carbonate having the average secondary particle diameter of 3.0 μm to 5.5 μm based on 100 parts by mass of total filler contained in the base paper.

7. The coated printing paper for an industrial inkjet printing press according to claim 2, wherein the total content, in terms of dry content, of the at least one material selected from the group consisting of a cationic resin and a water-soluble salt of a polyvalent cation contained in the base paper is 0.2 $g/m^2$ to 8.0 $g/m^2$.

8. The coated printing paper for an industrial inkjet printing press according to claim 3, wherein the total content, in terms of dry content, of the at least one material selected from the group consisting of a cationic resin and a water-soluble salt of a polyvalent cation contained in the base paper is 0.2 $g/m^2$ to 8.0 $g/m^2$.

9. The coated printing paper for an industrial inkjet printing press according to claim 6, wherein the total content, in terms of dry content, of the at least one material selected from the group consisting of a cationic resin and a water-soluble salt of a polyvalent cation contained in the base paper is 0.2 $g/m^2$ to 8.0 $g/m^2$.

10. The coated printing paper for an industrial inkjet printing press according to claim 2, wherein the at least one material selected from the group consisting of a cationic resin and a water-soluble salt of a polyvalent cation is added to the base paper using a size press.

11. The coated printing paper for an industrial inkjet printing press according to claim 3, wherein the at least one material selected from the group consisting of a cationic resin and a water-soluble salt of a polyvalent cation is added to the base paper using a size press.

12. The coated printing paper for an industrial inkjet printing press according to claim 4, wherein the at least one material selected from the group consisting of a cationic resin and a water-soluble salt of a polyvalent cation is added to the base paper using a size press.

13. The coated printing paper for an industrial inkjet printing press according to claim 6, wherein the at least one material selected from the group consisting of a cationic resin and a water-soluble salt of a polyvalent cation is added to the base paper using a size press.

14. The coated printing paper for an industrial inkjet printing press according to claim 7, wherein the at least one material selected from the group consisting of a cationic resin and a water-soluble salt of a polyvalent cation is added to the base paper using a size press.

15. The coated printing paper for an industrial inkjet printing press according to claim 8, wherein the at least one material selected from the group consisting of a cationic resin and a water-soluble salt of a polyvalent cation is added to the base paper using a size press.

16. The coated printing paper for an industrial inkjet printing press according to claim 9, wherein the at least one material selected from the group consisting of a cationic resin and a water-soluble salt of a polyvalent cation is added to the base paper using a size press.

* * * * *